US008668295B2

(12) United States Patent
Sugahara

(10) Patent No.: US 8,668,295 B2
(45) **Date of Patent: *Mar. 11, 2014**

(54) LIQUID DROPLET JETTING APPARATUS

(71) Applicant: Brother Kogyo Kabushiki Kaisha, Aichi-Ken (JP)

(72) Inventor: Hiroto Sugahara, Aichi-Ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/666,143

(22) Filed: Nov. 1, 2012

(65) Prior Publication Data

US 2013/0057617 A1 Mar. 7, 2013

Related U.S. Application Data

(62) Division of application No. 12/542,419, filed on Aug. 17, 2009, now Pat. No. 8,322,808.

(30) Foreign Application Priority Data

Aug. 21, 2008 (JP) ..... 2008-212419

(51) Int. Cl.

| | |
|---|---|
| ***B41J 3/60*** | (2006.01) |
| ***B41J 3/44*** | (2006.01) |
| *B41J 3/54* | (2006.01) |
| *B41J 2/205* | (2006.01) |

(52) U.S. Cl.

CPC ... *B41J 3/60* (2013.01); *B41J 3/543* (2013.01); *B41J 2/2052* (2013.01); *B41J 2202/21* (2013.01)

USPC ..... 347/9; 347/15; 347/43

(58) Field of Classification Search

None

See application file for complete search history.

(56) References Cited

U.S. PATENT DOCUMENTS

| | | | | |
|---|---|---|---|---|
| 5,746,526 | A | 5/1998 | Hirose | |
| 5,778,781 | A | 7/1998 | Mueller | |
| 6,663,215 | B2 | 12/2003 | Klausbruckner et al. | |
| 6,663,222 | B2 * | 12/2003 | Verhoest et al. | 347/42 |
| 7,198,419 | B2 | 4/2007 | Lee | |

(Continued)

FOREIGN PATENT DOCUMENTS

| | | |
|---|---|---|
| JP | 60223747 | 11/1985 |
| JP | 7314822 | 12/1995 |

(Continued)

OTHER PUBLICATIONS

Machine generated English translation of JP document JP 2007-190778A to Ichikawa et al., retrieved via http://www19.ipdl.inpdl.inpit.go.jp/PA1 /cgi-bin/PA 1INIT?;Oct. 4, 2011; 15 pgs.

*Primary Examiner* — Shelby Fidler

(74) *Attorney, Agent, or Firm* — Frommer Lawrence & Haug LLP

(57) ABSTRACT

There is provided a liquid droplet jetting apparatus including: a transporting mechanism; and a head moving mechanism configured to move the second liquid droplet jetting head between a first position facing the one surface of the object and a second position facing the other surface of the object. Under a condition that the second liquid droplet jetting head is arranged at the first position, a first nozzle row and a second nozzle row are arranged such that each of first nozzles is overlapped with one of second nozzles with respect to a nozzle-row direction.

2 Claims, 10 Drawing Sheets

PAPER FEEDING DIRECTION

(56) References Cited

U.S. PATENT DOCUMENTS

| | | | | |
|---|---|---|---|---|
| 2001/0021331 | A1 | 9/2001 | Brewington et al. | |
| 2002/0001027 | A1 | 1/2002 | Sugioka et al. | |
| 2003/0001914 | A1 | 1/2003 | Matsumoto et al. | |
| 2004/0179062 | A1 | 9/2004 | Rai et al. | |
| 2005/0078996 | A1 | 4/2005 | Lee | |
| 2006/0284906 | A1* | 12/2006 | Jeong et al. | 347/5 |
| 2009/0027449 | A1* | 1/2009 | Silva et al. | 347/47 |

FOREIGN PATENT DOCUMENTS

| | | |
|---|---|---|
| JP | 7314849 | 12/1995 |
| JP | 9001869 | 1/1997 |
| JP | 9123431 | 5/1997 |
| JP | 2002-011864 | 1/2002 |
| JP | 2007/190778 | 8/2007 |
| JP | 2008-156012 | 7/2008 |

* cited by examiner

PAPER FEEDING DIRECTION

PAPER FEEDING DIRECTION

PAPER FEEDING DIRECTION

LIQUID DROPLET JETTING APPARATUS

CROSS REFERENCE TO RELATED APPLICATION

The present application is a divisional application of U.S. patent application Ser. No. 12/542,419. The present application claims priority from Japanese Patent Application No. 2008-212419, filed on Aug. 21, 2008, the disclosure of which is incorporated herein by reference in its entirety.

BACKGROUND OF THE INVENTION

1. Field of the Invention

The present invention relates to a liquid droplet jetting apparatus which jets liquid droplets from nozzles.

2. Description of the Related Art

An ink-jet printing apparatus (ink-jet printer) in which two ink-jet heads extending to cover an entire length in a width direction of a paper are arranged face-to-face mutually, sandwiching the paper is known. An ink is jetted from the two printing heads, onto the paper transported in a transporting direction which is orthogonal to the width direction of the paper. Accordingly, it is possible to carry out printing simultaneously on both surfaces of the paper.

Moreover, an image forming apparatus in which one recording head is arranged to face only one side of a paper is also known. Moreover, in a case of carrying out printing only on one side of the paper, after the printing is carried out on one surface of the paper by jetting the ink from a recording head onto the transported paper, the paper is discharged. Whereas, in a case of carrying out printing on both surfaces (sides) of the paper, after the printing is carried out on one surface of the paper, the paper is turned over by carrying out switch-back transporting. Then, a printing is carried out on the opposite side of the paper by jetting the ink from the recording head, and the paper is discharged. In this manner, in the later image forming apparatus described above, a printing mode is switched to one of the printing only on one surface of a paper and the printing on both surfaces of the paper.

Here, in the former ink-jet printing apparatus described above, it is possible to carry out printing on both surfaces of a paper by jetting an ink from both the printing heads as it has been described above. Moreover, it is also possible to carry out printing only on one surface of the paper when the ink is jetted from only one of the two printing heads. Consequently, in the later ink-jet printing apparatus, it is possible to switch easily to one of the double-face printing or the single-face printing without providing a mechanism for carrying out the switch-back transporting by switching between whether to jet the ink from both the printing heads or to jet the ink from only one of the two ink-jet heads.

SUMMARY OF THE INVENTION

Here, it has been sought that a printing quality at the single-face printing would be higher than that at the double-face printing, or a printing speed at the single-face printing, would be higher than that at the double-face printing. However, both of the abovementioned inkjet printing apparatus and the image forming apparatus are not capable of responding to such requirement.

An object of the present invention is to provide a liquid droplet jetting apparatus which realizes making it possible at the time of jetting liquid droplets on to one surface of a recording medium, to jet the liquid droplets highly densely than at the time of jetting the liquid droplets on to both surfaces of a recording medium to make the time required for jetting the liquid droplets on one surface of a recording medium shorter than the time required for jetting the liquid droplets on both surfaces of a recording medium.

According to an aspect of the present teaching, there is provided a liquid droplet jetting apparatus which jets liquid droplets onto a plane-shaped object, including:

a transporting mechanism which transports the object on which the liquid droplets are to be jetted, along a predetermined transporting path;

a first liquid droplet jetting head including a first nozzle which is formed in the first liquid jetting head, through which the liquid droplets are jetted, and which is arranged to face one surface of the object transported by the transporting mechanism;

a second liquid droplet jetting head including a second nozzle which is formed in the second liquid jetting head, and through which the liquid droplets are jetted, the second liquid droplet jetting head being movable between a first position facing the one surface of the object transported by the transporting mechanism and a second position facing the other surface of the object transported by the transporting mechanism; and a head moving mechanism which moves the second liquid droplet jetting head between the first position and the second position.

Accordingly, by moving the second liquid droplet jetting head to the first position, it is possible to jet the liquid droplets only on the one surface of the object by using the first liquid droplet jetting head and the second liquid droplet jetting head, and by moving the second liquid droplet jetting head to the second position, it is possible to jet the liquid droplets on both surfaces of the object by using the first liquid droplet jetting head and the second liquid droplet jetting head. When the first liquid jetting head is arranged at the first position, in a case in which, a position of the first nozzle of the first liquid droplet jetting head, and a position of the second nozzle of the second liquid droplet jetting head are not misaligned (are not shifted), it becomes possible (it is possible) to jet the liquid droplets at a high speed as compared to a case of jetting the liquid droplets on both surfaces, and in a case in which (the position of) the first nozzle and (the position of) the second nozzle are arranged to be mutually misaligned, it becomes possible (it is possible) to jet the liquid droplets highly densely as compared to the case of jetting the liquid droplets on both surfaces. Furthermore, in any of the cases namely, the case of jetting the liquid droplets only on one surface of the (jetting) object, and the case of jetting the liquid droplets on both surfaces of the object of jetting, both the first liquid droplet jetting head and the second liquid droplet jetting head are used, and a frequency of use of one of the first liquid droplet jetting head and the second liquid droplet jetting head is not lowered than a frequency of use of the other.

BRIEF DESCRIPTION OF THE DRAWINGS

FIG. 1 is viewed from a direction of an arrow II, where, FIG. 2A shows a state in which nozzles of both ink-jet heads are facing an upper surface of a recording paper, and FIG. 2B shows a state in which, nozzles of one of the two ink-jet heads are facing the upper surface of the recording paper, and the nozzles of the other ink-jet head are facing a lower surface of the recording paper;

DETAILED DESCRIPTION OF THE PREFERRED EMBODIMENTS

An exemplary embodiment of the present invention will be described below.

Figure 1:
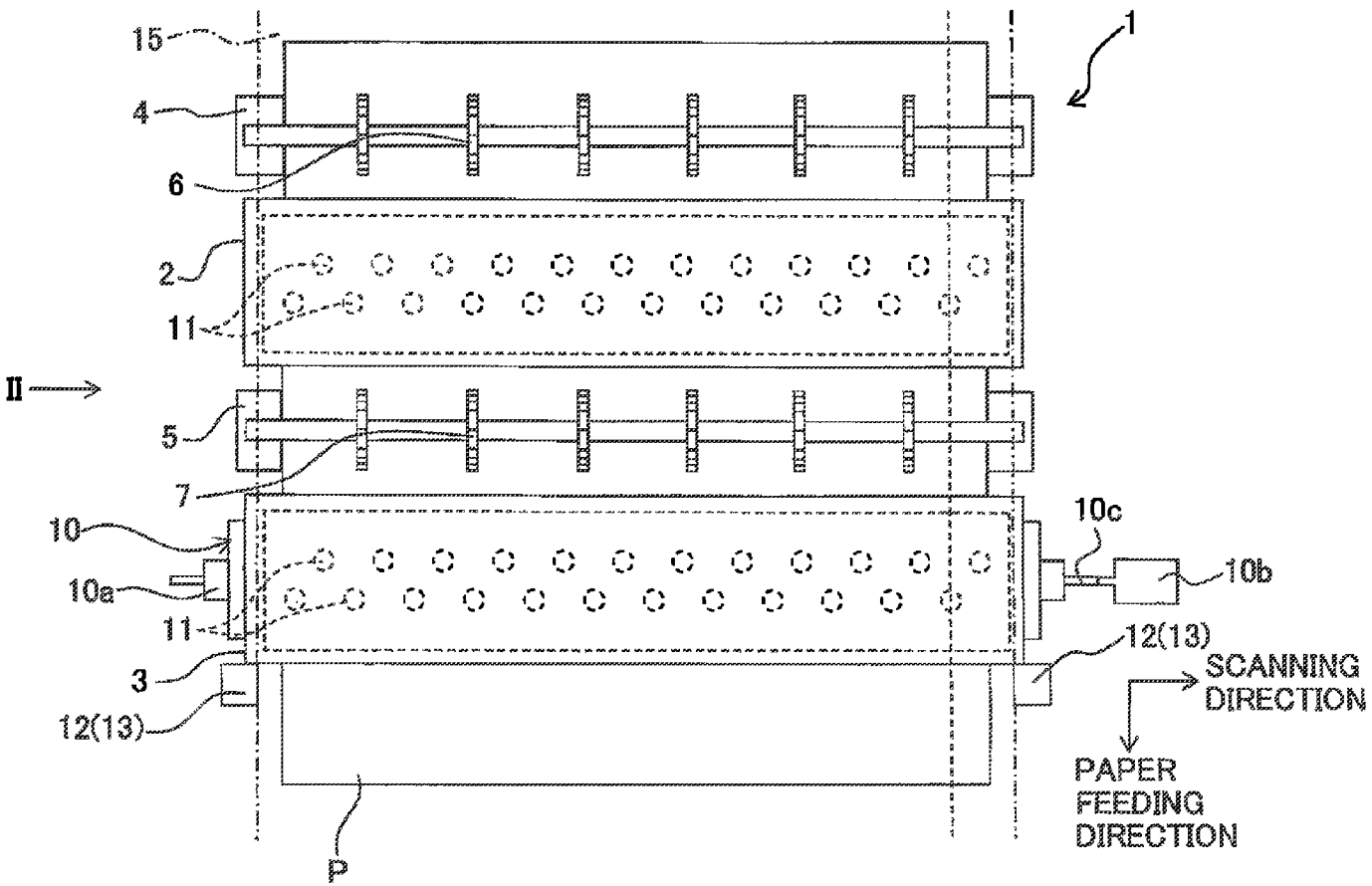
FIG. 1 is a schematic structure of a printer according to an embodiment of the present invention, viewed from a top.
Figure 2A:
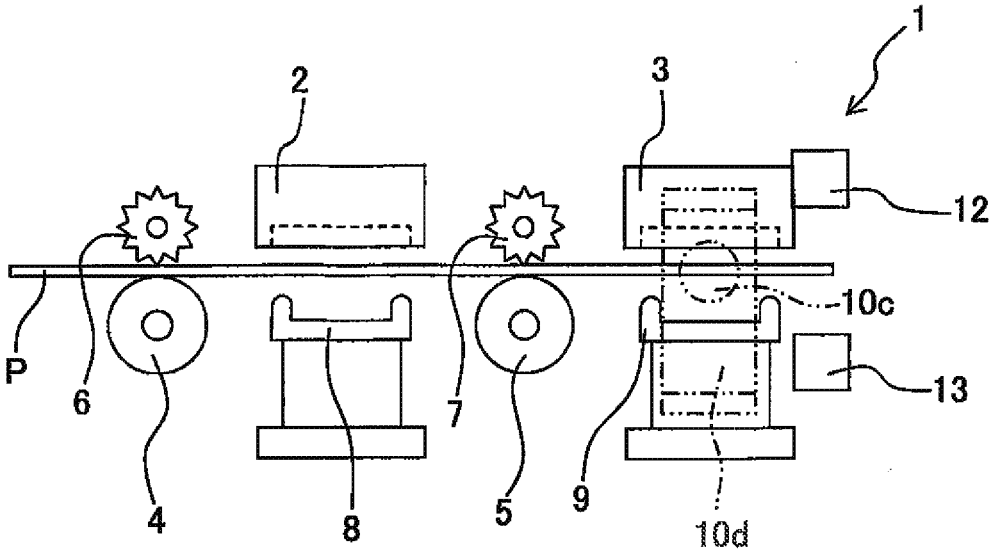
FIGS. 2A and 2B are side views when (the printer in)
Figure 2B:
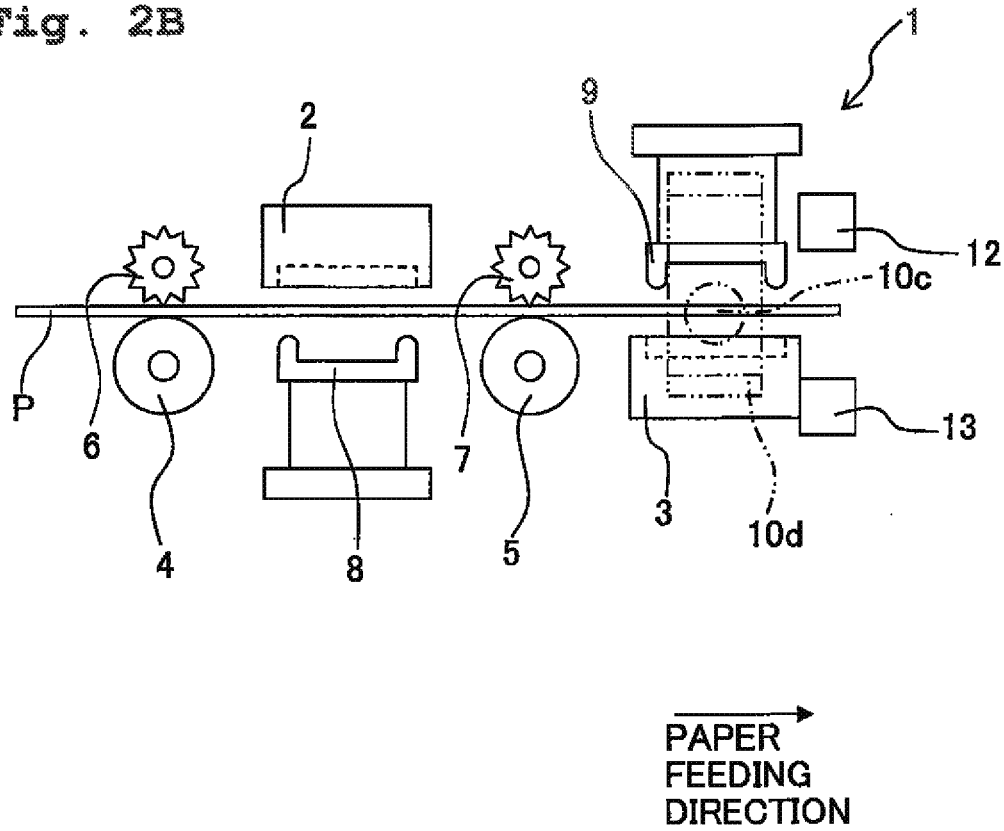

As shown in FIGS. 1, 2A, and 2B, a printer 1 (a liquid droplet jetting apparatus) includes ink-jet heads 2 and 3, transporting rollers 4 and 5, spur-rollers 6 and 7, caps 8 and 9, and an reversing-mechanism 10.

The ink-jet heads 2 and 3 are so-called line type ink-jet heads which jet ink in a stationary state. The ink-jet heads 2 and 3 are extended to be spread over an entire length of a recording paper P (jetting object) in a scanning direction (left-right direction in FIG. 1), and jets an ink of same color from a plurality of nozzles 11 arranged in a row along the scanning direction, on a surface facing the recording paper P. Moreover, the ink-jet head 2 and the ink-jet head 3 are arranged along a paper transporting direction (a direction of extension of a paper transporting path 15 which will be described later, a vertical direction in FIG. 1) which is orthogonal to the scanning direction, such that the ink-jet head 2 is arranged at an upper side (an upstream side of the transporting path 15 which will be described later) of FIG. 1, and the nozzles 11 of the ink-jet head 2 and the nozzles 11 of the ink-jet head 3 are arranged at a same position in the scanning direction.

The ink-jet head 2 is fixed to the printer 1 to face an upper surface (one surface) of the recording paper P. Whereas, as it will be described later, it is possible to move the ink-jet head 3 selectively to one of a position at which the nozzles 11 face the upper surface of the recording paper P (a first position), and another position at which the nozzles 11 face a lower surface (the other surface) of the recording paper P (a second position). In the embodiment, the ink-jet head 2 corresponds to a first liquid droplet jetting head according to the present invention, and the ink-jet head 3 corresponds to a second liquid droplet jetting head according to the present invention.

Here, as shown in FIG. 1, the reversing-mechanism 10 includes a pair of handle portions 10*a* having a substantial T-shape, which is arranged on both sides in a longitudinal direction of the ink-jet head 3, and which supports the ink-jet head 3, and an inverting drive portion 10*b* which is coupled with the handle portions 10*a*, and which rotates the ink-jet head 3. The inverting drive portion 10*b* is formed of a combination of components such as a motor and a gear. Moreover, the handle portion 10*a* includes a shaft portion 10*c* which is extended in the longitudinal direction of the ink-jet head 3, and which is coupled with the inverting drive portion lob, and a supporting portion 10*d* which is extended toward both sides of a direction orthogonal to the shaft portion 10*c*. The ink-jet head 3 and the cap 9 are supported by two sides respectively, of the supporting portion 10*d*. Accordingly, it is possible to rotate the ink-jet head 3 and the cap 9 around the shaft portion 10*e*, while maintaining a space (a distance) between the ink-jet head 3 and the cap 9.

The transporting rollers 4 and 5 are rollers without any projection and recess (without unevenness) on a surface thereof. In FIG. 1, the transporting roller 4 is arranged to face the lower surface of the recording paper P at a left side (the upstream side of the transporting path 15) of the ink-jet head 2. The transporting roller 5 is arranged between the ink-jet head 2 and the ink-jet head 3 (at a downstream side of the transporting path 15 which will be described later, with respect to the ink-jet head 2), to face the lower surface of the recording paper P. A motor which is not shown in the diagram is connected to the transporting rollers 4 and 5, and the transporting rollers 4 and 5 rotate by the motor.

A plurality of protrusions is formed on the spur-rollers 6 and 7, along a circumferential direction thereof. The spur-roller 6 is arranged to face the transporting roller 4, pinching the recording paper P (between the spur-roller 6 and the transporting roller 4). The spur-roller 7 is arranged to face the transporting roller 5, pinching the recording paper P between the spur-roller 7 and the transporting roller 5. Accordingly, when the transporting rollers 4 and 5 rotate, the spur-rollers 6 and 7 also rotate with the rotation of the transporting rollers 4 and 5. As a result, the recording paper P which is pinched between the transporting roller 4 and the spur-roller 6 and which is also pinched between the transporting roller 5 and the spur-roller 7 is transported in a paper transporting direction (leftward direction in FIG. 1) along the transporting path 15 which is extended in the left-right direction in FIG. 1.

In the embodiment, a pair of the transporting roller 4 and the spur-roller 6 corresponds to a first roller pair according to the present invention, and a pair of the transporting roller 5 and the spur-roller 7 corresponds to a second roller pair according to the present invention.

The caps 8 and 9 are arranged to face the nozzles 11 of the ink-jet head 2 and the nozzles 11 of the ink-jet head 3 respectively, and are movable in a vertical direction. When no printing is carried out by the printer 1, the caps 8 and 9 move up to positions making a close contact with a surface of the ink-jet heads 2 and 3 in which the nozzles 11 are formed, and cover the nozzles 11. Accordingly, the drying of the ink inside the nozzles 11 is prevented. On the other hand, when printing is carried out by the printer, when the caps 8 and 9 are separated (drawn) away from the ink-jet heads 2 and 3, the nozzles 11 are exposed, and accordingly, it becomes possible to jet the ink on to the recording paper P from the nozzles 11. In the embodiment, the cap 8 corresponds to a first cap according to the present invention, and the cap 9 corresponds to a second cap according to the present invention.

As it has been described above, the reversing-mechanism 10 (a head moving mechanism) is positioned between the ink-jet head 3 and the cap 9 in the vertical direction, and is rotatable around a shaft 10 parallel to the scanning direction. Furthermore, the supporting portion 10*d* of the reversing-mechanism 10 is fixed to the ink-jet head 3 and the cap 9 respectively. Accordingly, when the reversing-mechanism 10 is driven, the ink-jet head 3 and the cap 9 rotate while facing mutually. Moreover, in the printer 1, it is possible to move the ink-jet head 3 selectively to one of a first position and a second position by rotating the reversing-mechanism 10. Here, as shown in FIG. 2A, the first position is a position at which the nozzles 11 face the upper surface of the recording paper P, at a right side (the downstream side of the transporting path 15) in FIGS. 2A and 2B of the transporting roller 5 and the spur-roller 7, and as shown in FIG. 2B, the second position is a position at which the nozzles 11 face the lower surface of the recording paper P, at a left side (downstream side of the transporting path 15) in FIGS. 2A and 2B of the transporting roller 5 and the spur-roller 7 as shown in FIG. 2B. In the embodiment, the first position and the second position are at the same position in the paper transporting direction.

At this time, the nozzles 11 of the ink-jet head 3, and the cap 9 rotate together while facing mutually. Even when the ink-jet head 3 is at one of the first position and the second position, the nozzles 11 of the ink-jet head 3 face the cap 9. Therefore, when printing is not carried out, it is possible to cover the nozzles 11 of the ink-jet head 3 by the cap 9 immediately. Accordingly, it is possible to prevent assuredly the drying of ink inside the nozzles 11 of the ink-jet head 3. Moreover, since the nozzles 11 of the ink-jet head 2 which is fixed to the printer 1 always face the cap 8, when printing is not carried out, it is possible to cover the nozzles 11 of the ink-jet head 2 by the cap 8 immediately.

Here, the printer 1 includes a contact member 12 which makes a contact with a side surface on the right side in FIGS. 2A and 2B of the ink-jet head 3 which is at the first position, and a contact member 13 which makes a contact with a side surface on the right side in FIGS. 2A 2B of the ink-jet head 3 which is at the second position. When the ink-jet head 3 is moved to the first position and the second position as described above, the ink-jet head 3 makes a contact with the contact member 12 and the contact member 13. Accordingly, the ink-jet head 3 is positioned at the first position and the second position.

Next, a method of carrying out printing only on one surface (upper surface) of the recording paper P by using the printer 1, and a method of carrying out printing on both surfaces of the recording paper P by using the printer 1 will be described below.

In a case of carrying out printing only on one surface of the recording paper P, the reversing-mechanism 10 is rotated and the ink-jet head 3 is moved to the first position at which the nozzles 11 of the ink-jet head 3 face the upper surface of the recording paper P. Moreover, the printing is carried out on the upper surface of the recording paper P by jetting the ink from the nozzles 11 of the ink-jet heads 2 and 3 onto the upper surface of the recording paper P which is transported by the transporting rollers 4 and 5 and the spur-rollers 6 and 7.

In this case, as it has been described above, since the nozzles 11 of the ink-jet head 2 and the nozzles 11 of the ink-jet head 3 are at the same position in the scanning direction, the ink may be jetted on each point on the upper surface of the recording paper P only from the nozzles 11 of one of the two ink-jet heads 2 and 3. In this manner, since it is possible to jet the ink from the nozzles 11 of the two ink-jet heads 2 and 3, it is possible to carry out the printing at a high speed on the upper surface of the recording paper P. Here, when the nozzles 11 of the ink-jet head 2 and the nozzles 11 of the ink-jet head 3 are arranged to be misaligned (shifted) in the scanning direction, it is possible to jet the ink highly densely on the upper surface of the recording paper P, and it is possible to achieve a high-quality printing as compared to a case of the double-face printing. It is preferable that the nozzles 11 of the ink-jet head 2 and the nozzles 11 of the ink-jet head 3 are arranged to be misaligned (shifted) mutually by only half of a pitch in the scanning direction, since it is possible to carry out printing with twice the resolution as compared to the case of the double-face printing.

On the other hand, in a case of carrying out printing on both surfaces of the recording paper P, the reversing-mechanism 10 is rotated, and the ink-jet head 3 is moved to the second position at which the nozzles 11 of the ink-jet head 3 face the lower surface of the recording paper P. Moreover, the ink is jetted from the nozzles 11 of the ink-jet head 2 onto the upper surface of the recording paper P which is transported by the transporting rollers 4 and 5, and the spur-rollers 6 and 7. At this time, since it is possible to jet the ink from the nozzles 11 of the ink-jet head 3 onto the lower surface of the recording paper P simultaneously, it is possible to carry out the printing simultaneously on both surfaces of the recording paper P.

As it has been described above, the second position is arranged on the right side (downstream side of the transporting path 15) in FIGS. 2A and 2B of the transporting roller 5 and the spur-roller 7. Therefore, after the recording paper P has passed between the transporting roller 4 and the spur-roller 6, and between the transporting roller 5 and the spur-roller 7, the ink is jetted onto the lower surface of the recording paper P from the nozzles 11 of the ink-jet head 3. Therefore, the ink jetted onto the lower surface of the recording paper P is not adhered to the transporting rollers 4 and 5. Consequently, the ink is not adhered to the other portion of the recording paper P from the transporting rollers 4 and 5, and it is possible to prevent the printing quality from being degraded.

Moreover, in both the cases namely, the case of carrying out printing on only one surface of the recording paper P, and the case of carrying out printing on both surfaces of the recording paper P, firstly, the ink jetted from the nozzles 11 of the ink-jet head 2 lands on the upper surface of the recording paper P. Thereafter, the recording paper P passes between the transporting roller 5 and the spur-roller 7, and the upper surface of the recording paper P makes a contact with the spur-roller 7. However, the plurality of protrusions is formed on the spur-roller 7 along the circumferential direction thereof. Since the spur-roller 7 makes a contact with the recording paper P only at a front-end portion of the protrusions, a contact area of the spur-roller 7 and the recording paper P is small. Therefore, the ink is hardly adhered to the spur-roller 7, and further to other portion of the recording paper P. Accordingly, it is possible to prevent the printing quality from being degraded.

Furthermore, when the printing is carried out on the recording paper P as it has been described above, in both the cases namely, the case of carrying out printing on only one surface of the recording paper P, and the case of carrying out printing on both the surfaces of the recording paper P, both the ink-jet heads 2 and 3 are used. Therefore, a situation such that the frequency of use of one of the ink-jet heads 2 and 3 is lower than the frequency of use of the other does not arise.

According to the embodiment described above, in a case of jetting the ink from the nozzles 11 of the ink-jet heads 2 and 3 after moving the ink-jet head 3 to the first position at which the nozzles 11 of the ink-jet head 3 face the upper surface of the recording paper P, it is possible to carry out printing only on one surface (the upper surface) of the recording paper P. Moreover, in a case of jetting the ink from the nozzles 11 of the ink-jet heads 2 and 3 after moving the ink-jet head 3 to the second position at which the nozzles 11 of the ink-jet head 3 face the lower surface of the recording paper P, it is possible to carry out printing on both surfaces of the recording paper P. By carrying out printing in such manner, in both the cases, namely the case of carrying out printing on only one surface of the recording paper P, and the case of carrying out printing on both surfaces of the recording paper P, both the ink-jet heads 2 and 3 are used. Therefore, the frequency of use of one of the ink-jet heads 2 and 3 does not become lower than the frequency of use of the other ink-jet head. Therefore, it is possible to avoid a recording element (a piezoelectric element in a case of a piezoelectric type, and a heater in a case of a bubble-jet type) of one of the ink-jet heads from being degraded extremely rapidly than a recording element of the other ink-jet head. In other words, in a case of carrying out printing on a predetermined number of recording papers P in a predetermined period, it is possible to make long a life of the ink-jet head.

Moreover, in both the cases namely the case of carrying out printing on only one surface of the recording paper P, and the case of carrying out printing on both surfaces of the recording paper P, firstly, the ink jetted from the nozzles 11 of the ink-jet head 2 lands on the upper surface of the recording paper P, and thereafter, the recording paper P passes between the transporting roller 5 and the spur-roller 7, and the upper surface of the recording paper P makes a contact with the spur-roller 7. However, the plurality of protrusions is formed on the spur-roller 7 along the circumferential direction thereof. Since the spur-roller 7 makes a contact with the recording paper P only at the front end portion of the protrusions, the contact area of the spur-roller 7 and the recording paper P is small. Therefore, the ink is hardly adhered to the spur-roller 7, and further to other portion of the recording paper P. Accordingly, it is possible to prevent the printing quality from being degraded.

Moreover, in the case of carrying out printing on both sides of the recording paper P, after the recording paper P has passed between the transporting roller 4 and the spur-roller 6, and between the transporting roller 5 and the spur-roller 7, the ink is jetted onto the lower surface of the recording paper P from the nozzles 11 of the ink-jet head 3. Therefore, the ink landed on the lower surface of the recording paper P is not adhered to the transporting roller 5. Consequently, the ink is not adhered to the other portion of the recording paper P from the transporting roller 5, and it is possible to prevent the printing quality from being degraded.

Next, modified embodiments in which various modifications are made in the embodiment will be described below. Same reference numerals are assigned to components having a similar structure as in the embodiment, and the description of such components is omitted.

First Modified Embodiment

Figure 3:
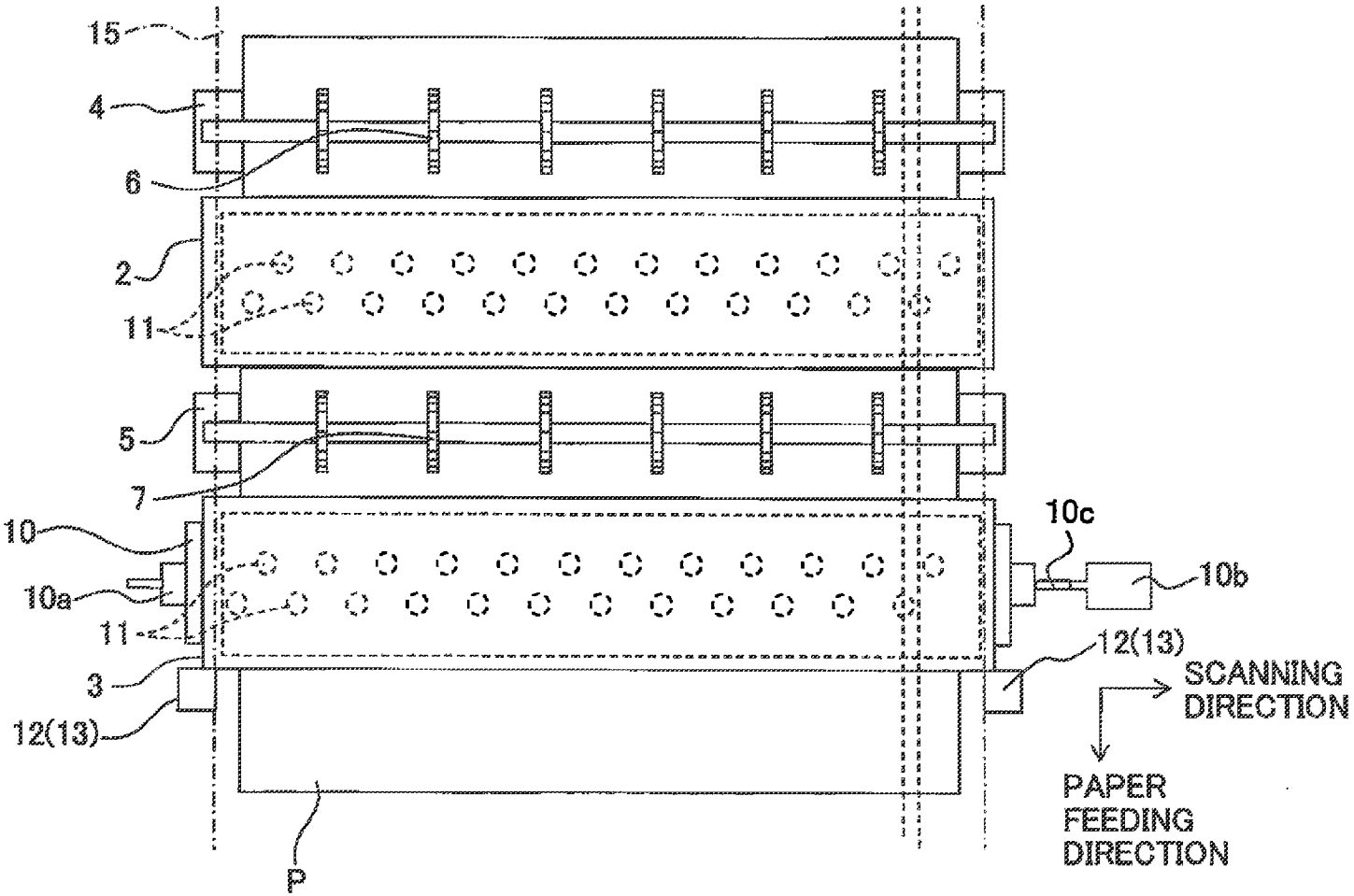
FIG. 3 is a diagram corresponding to FIG. 1, of a first modified embodiment.

In a first modified embodiment, as shown in FIG. 3, the nozzles 11 of the ink-jet head 2 and the nozzles 11 of the ink-jet head 3 are shifted by a length half of an interval (a distance) of the nozzles 11 in the ink-jet heads 2 and 3, in the scanning direction (left-right direction in FIG. 3).

In this case, similarly as in the embodiment, it is possible to jet the ink from the nozzles 11 of the ink-jet heads 2 and 3 after moving the ink-jet head 3 to the first position at which the nozzles 11 of the ink-jet head 3 face the upper surface of the recording paper P. Accordingly, it is possible to carry out printing on only one surface of the recording paper P. In this case, since the ink jetted from the nozzles 11 of the ink-jet head 3 lands between the ink jetted from the nozzles 11 of the ink-jet head 2, it is possible to carry out a high-resolution printing on the recording paper P.

Even in this case, similarly as in the embodiment, it is possible to jet the ink from the nozzles 11 of the ink-jet heads 2 and 3 after moving the ink-jet head 3 to the second position at which the nozzles 11 of the ink-jet head 3 face the lower surface of the recording paper P. Accordingly, it is possible to carry out printing on both surfaces of the recording paper P. However, in this case, since the ink is jetted only from the nozzles 11 of one of the ink-jet heads 2 and 3 onto each surface of the recording paper P, the quality of the image printed is not a high image quality as in the case when the single-face printing is carried out, and the image quality is similar as the image quality in the embodiment. Moreover, since the nozzles 11 of the ink-jet head 2 and the nozzles 11 of the ink-jet head 3 are arranged to be mutually shifted in the scanning direction, there occurs a small shift (misalignment) between an image printed on the upper surface of the recording paper P and an image printed on the lower surface of the recording paper P. However, this shift is about a few tens of μm, and is not visible.

Second Modified Embodiment

Moreover, in the embodiment, the ink-jet head 3 and the cap 9 are fixed to the reversing-mechanism 10. Moreover, when the reversing-mechanism 10 is rotated, the ink-jet head 3 and the cap 9 have been moving together while facing mutually. However, the present invention is not restricted to such arrangement.

Figure 4A:
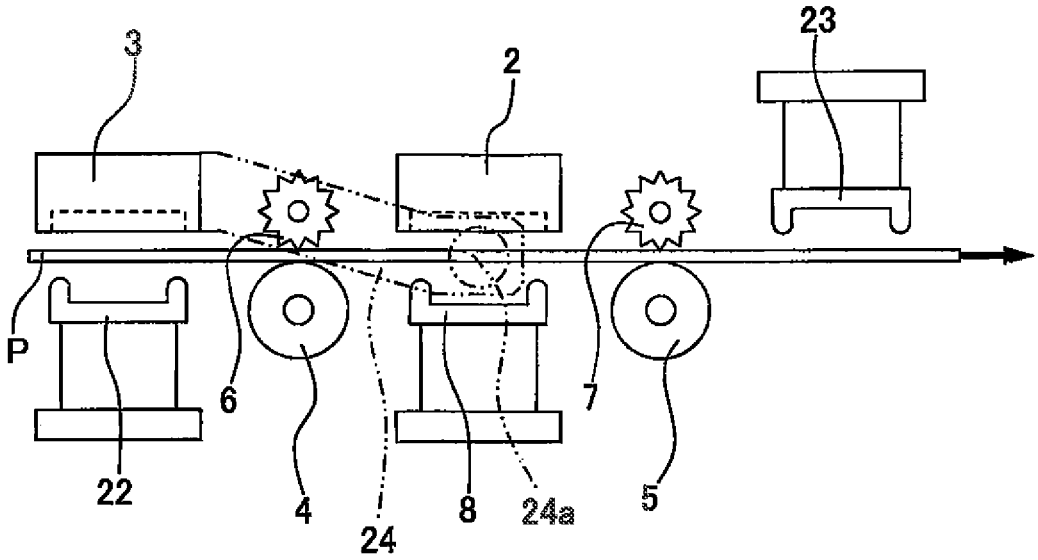
FIGS. 4A and 4B are diagrams corresponding to FIGS. 2A and 2B respectively, of a second modified embodiment.
Figure 4B:
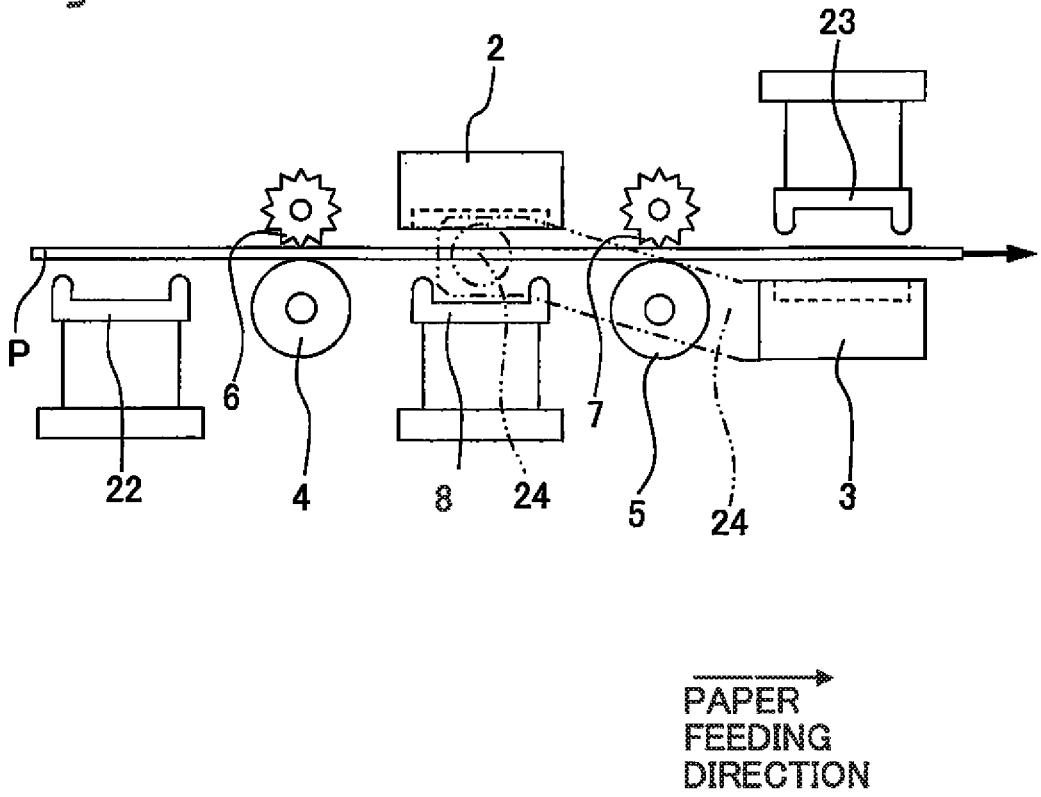

In a second modified embodiment, as shown in FIG. 4, caps 22 and 23 (second caps) are provided instead of the cap 9 in the embodiment, and an reversing-mechanism 24 is provided instead of the reversing-mechanism 10.

The cap 22 is arranged facing the lower surface of the recording paper P on a left side (the upstream side of the transporting path 15) of the transporting roller 4 in the diagram, and the cap 23 is arranged facing the upper surface of the recording paper P on a right side (the downstream side of the transporting path 15) of the transporting roller 5. The reversing-mechanism 24 is rotatable around a shaft 24*a* arranged between the ink-jet head 2 and the cap 8. Moreover, a front-end portion of the reversing-mechanism 24 is fixed to the ink-jet head 3. When the reversing-mechanism 24 is rotated, the ink-jet head 3 rotates. Accordingly, it is possible to move the ink-jet head 3 to a position (a first position) on a left side (the upstream side of the transporting path 15) in FIG. 4 of the transporting roller 4 and the spur-roller 6 at which the nozzles 11 of the ink-jet head 3 face the cap 22 and the upper surface of the recording paper P. Moreover, it is possible to move the ink-jet head 3 selectively to a position (a second position) on a right side (the downstream side of the transporting path 15) in FIG. 4 of the transporting roller 5 and the spur-roller 7, at which the nozzles 11 of the ink-jet head 3 face the cap 22 and the lower surface of the recording paper P. In this case, at the time of moving the ink-jet head 3, the caps 22 and 23 are to be moved vertically such that the ink-jet head 3 and the caps 22 and 23 do not make a contact.

When the ink-jet head 3 is at the first position, the nozzles 11 of the ink-jet head 3 face the cap 22. Moreover, when the ink-jet head 3 is at the second position, the nozzles 11 face the cap 23. In other words, when the ink-jet head 3 is at any of the first position and the second position, the nozzles 11 of the ink-jet head 3 face one of the cap 22 and the cap 23. Therefore, when the printing is not to be carried out, it is possible to cover the nozzles 11 of the ink-jet head 3 immediately by one of the cap 22 and the cap 23, and it is possible to prevent assuredly the drying of the ink inside the nozzles 11.

In the single-face printing, after the ink jetted form the nozzles 11 of the ink-jet head 3 has landed on the upper surface of the recording paper P, the recording paper P passes between the transporting roller 4 and the spur-roller 6, and between the transporting roller 5 and the spur-roller 7. Therefore, the upper surface of the recording paper P makes a contact with the spur-rollers 6 and 7. Moreover, in the single-face printing and the double-face printing, after the ink jetted from the nozzles 11 of the ink-jet head 2 has landed on the upper surface of the recording paper P, the recording paper P passes between the transporting roller 5 and the spur-roller 7, and the upper surface of the recording paper P makes a contact with the spur-roller 7. However, similarly as in the embodiment described above, since the contact area between the spur-rollers 6 and 7 and the recording paper P is small, the ink landed on the upper surface of the recording paper P hardly adheres to the spur-rollers 6 and 7, and the ink adhered to the spur-rollers 6 and 7 hardly adheres to the other portion of the recording paper P. Accordingly, the printing quality is prevented from being degraded.

Moreover, at the time of carrying out the double-face printing, after the recording paper P has passed between the transporting roller 4 and the spur-roller 6, and between the transporting roller 5 and the spur-roller 7, the ink is jetted from the nozzles 11 of the ink-jet head 3 onto the lower surface of the recording paper P. Therefore, the ink landed on the lower surface of the recording paper P is not adhered to the transporting rollers 4 and 5. Consequently, the ink is not further adhered to the other portion of the recording paper P from the transporting rollers 4 and 5, and the printing quality is prevented from being degraded.

Even in this case, at the time of carrying out any of the single-face printing and the double-face printing, both the ink-jet heads 2 and 3 are used. Therefore, the frequency of use of one of the ink-jet heads 2 and 3 is not lowered than the frequency of use of the other.

A positional relationship of the ink-jet head, the transporting rollers, and the spur-rollers is not restricted to the positional relationship described in the embodiment.

Third Modified Embodiment

Figure 5A:
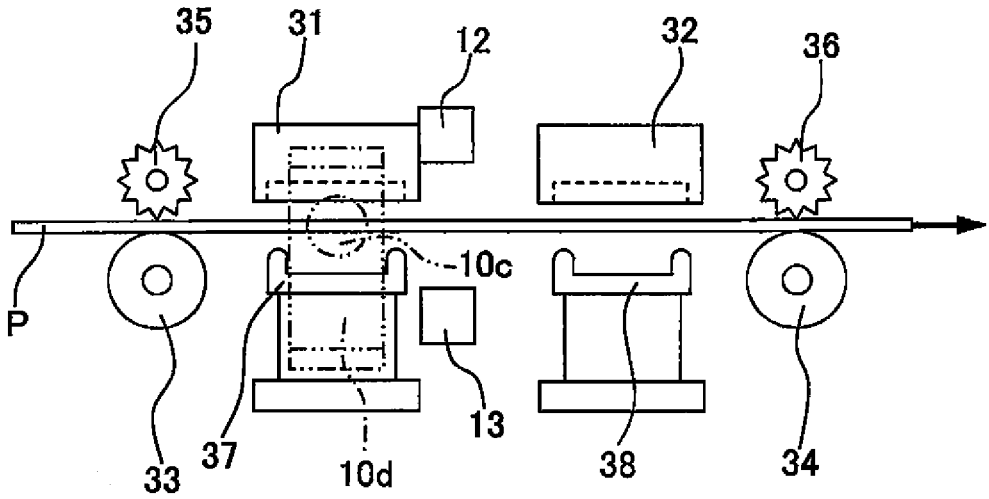
FIGS. 5A and 5B are diagrams corresponding to FIGS. 2A and 2B respectively, of a third modified embodiment.
Figure 5B:
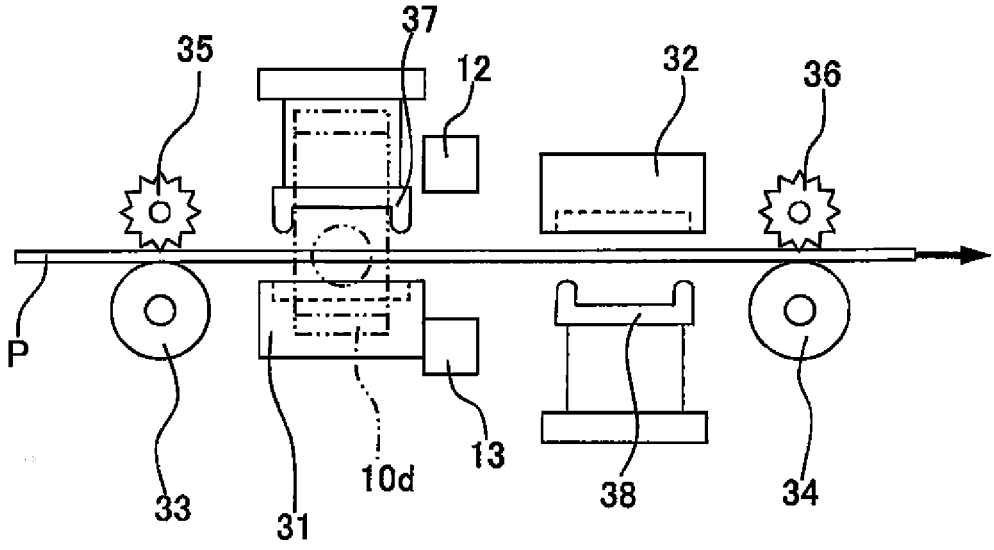

As shown in FIGS. 5A and 5B, transporting rollers 33 and 34 are arranged to be sandwiching two ink-jet heads 31 and 32, and caps 37 and 38 facing the ink-jet heads 31 and 32 respectively, in the paper transporting direction (left-right direction in FIG. 5). Furthermore, spur-rollers 35 and 36 are arranged to be sandwiching the recording paper P between the transporting roller 33 and the spur-roller 35, and between the transporting roller 34 and the spur-roller 36. Moreover, the ink-jet heads 31 and 32 have similar structures as the ink-jet heads 2 and 3 (refer to FIGS. 2A and 2B). The ink-jet head 32 arranged at a right side (the downstream side of the transporting path 15) in FIGS. 5A and 5B is fixed to the printer 1. Whereas, it is possible to rotate the ink-jet head 31 arranged at a left side (the upstream side of the transporting path 15) by using the reversing-mechanism 10. Accordingly, it is possible to move the ink-jet head 31 selectively to one of a position (a first position) at which the nozzles 11 of the ink-jet head 3 face the upper surface of the recording paper P, and a position (a second position) at which the nozzles 11 of the ink-jet head 3 face the lower surface of the recording paper P. Even in this case, the first position and the second position are the same positions with respect to the paper transporting direction. In this case, a pair of the transporting roller 33 and the spur-roller 35, and a pair of the transporting roller 34 and the spur-roller 36 correspond to two sets of roller pairs according to the present invention.

In this case, it is possible to carry out printing on only one surface (upper surface) of the recording paper P by jetting the ink on to the recording paper P from the nozzles 11 of the ink-jet heads 31 and 32 after moving the ink-jet head 31 to the first position as shown in FIG. 5A.

On the other hand, it is possible to carry out printing on both surfaces of the recording paper P by jetting the ink on to the recording paper P from the nozzles 11 of the ink-jet heads 31 and 32 after moving the ink-jet head 31 to the second position as shown in FIG. 5B.

In this manner, the ink-jet head 32 of the third modified embodiment is movable selectively to one of the position at which the nozzles 11 of the ink-jet head 32 face the upper surface of the recording paper P, and the position at which the nozzles 11 of the ink-jet head 32 face the lower surface of the recording paper P, without changing the position of the ink-jet head 32 in the paper transporting direction. Here, inversely as in the third modified embodiment, when the ink is jetted onto the lower surface of the recording paper P from the nozzles 11 of the ink-jet head 32, a distance between the ink-jet head 32 and the transporting roller 34 becomes small in the paper transporting direction. Therefore, after the ink has landed on the lower surface of the recording paper P, there is a possibility that the recording paper P passes between the transporting roller 34 and the spur-roller 36 before the ink thereon has dried sufficiently. Accordingly, there is a possibility that the ink adheres to the transporting roller 34, and the ink adhered to the transporting roller 34 adheres further to the other portion of the recording paper P, thereby degrading the printing quality.

Whereas, in the third modified embodiment, the ink is jetted onto the lower surface of the recording paper P from the nozzles 11 of the ink-jet head 31 which is at a position away from the transporting roller 34 and the spur-roller 36 through which the recording paper P passes after the ink has landed thereon. Therefore, as compared to the above-mentioned case, the time from the landing of the ink on the lower surface of the recording paper P up to passing between the transporting roller 34 and the spur-roller 36 becomes long. Consequently, the recording paper P passes between the transporting roller 34 and the spur-roller 36 upon drying of the ink thereon sufficiently, after the ink has landed on the lower surface thereof. Even when the lower surface of the recording paper P on which the ink has landed makes a contact with the transporting roller 34 with even surface, the ink hardly adheres to the transporting roller 34, and hardly adheres further to the other portion of the recording paper P. Accordingly, the printing quality is prevented from being degraded.

Moreover, in this case, at the time of carrying out printing only on one surface of the recording paper or at the time of carrying out printing on both surface of the recording paper P, the recording paper P passes between the transporting roller 34 and the spur-roller 36 after the ink has landed on the upper surface of the recording paper P, and the upper surface of the recording paper P makes a contact with the spur-roller 36. However, similarly as in the embodiment described above, since the contact area of the recording paper P and the spur-roller 36 is small, the ink landed on the upper surface of the recording paper P hardly adheres to the spur-roller 36, and the ink hardly adheres further to the other portion of the recording paper P. Accordingly, the printing quality is prevented from being degraded.

Even in this case, at the time of carrying out printing on one surface of the recording paper P or at the time of carrying out printing on both surfaces of the recording paper P, both the ink-jet heads 31 and 32 are used. Therefore, the frequency of use of one of the ink-jet heads 31 and 32 is not lowered than the frequency of use of the other.

Fourth Modified Embodiment

Figure 6A:
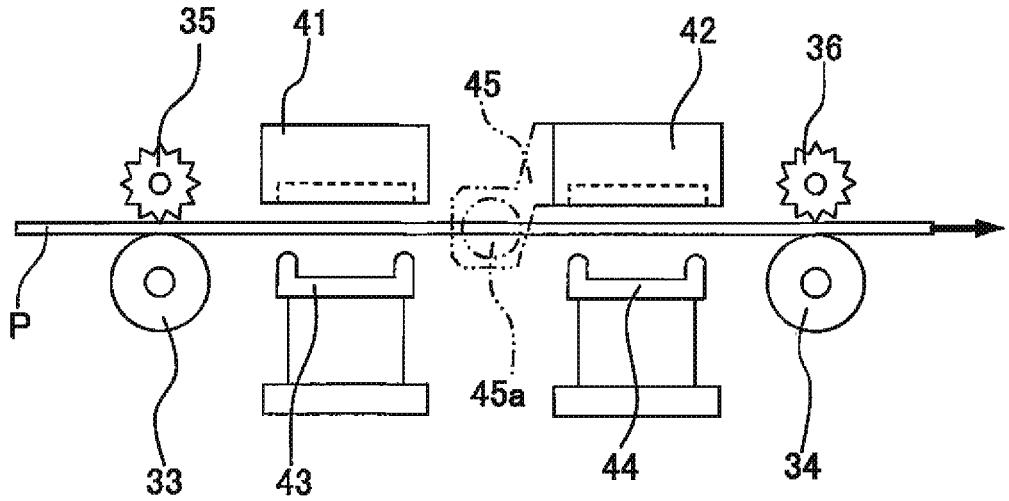
FIGS. 6A and 6B are diagrams corresponding to FIGS. 2A and 2B respectively, of a fourth modified embodiment.
Figure 6B:
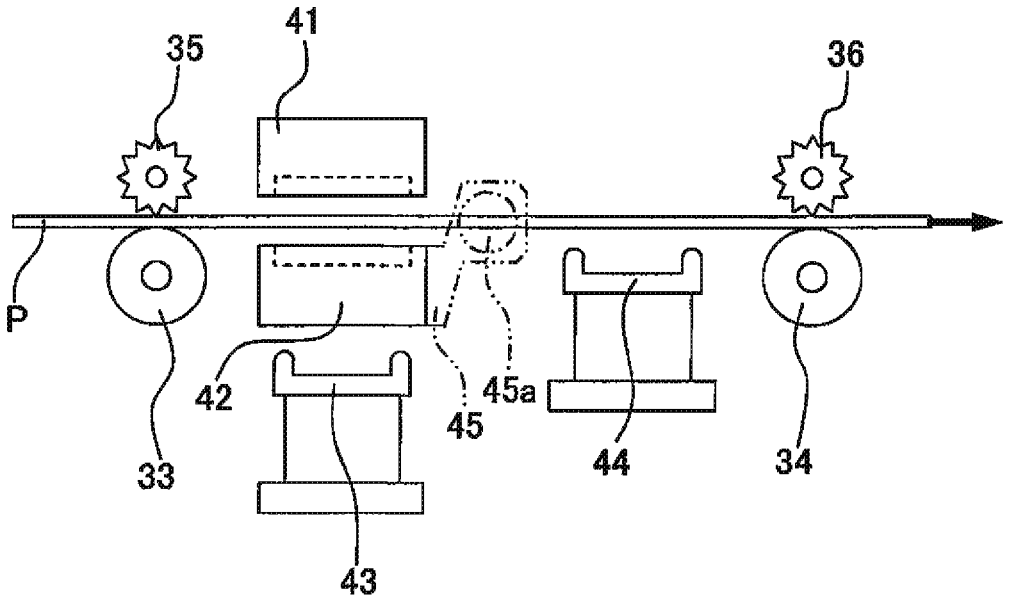

As shown in FIGS. 6A and 6B, the ink-jet printer includes ink-jet heads 41 and 42, and caps 43 and 44 sandwiched between the pair of the transporting roller 33 and the spur-roller 35, and the pair of the transporting roller 34 and the spur-roller 36 (two sets of roller pairs), in the paper transporting direction, similarly as in the third modified embodiment.

The caps 43 and 44 are arranged in line along the paper transporting direction (left-right direction in FIGS. 6A and 6B), facing the lower surface of the recording paper P. The ink-jet heads 41 and 42 have structures similar to the ink-jet heads 2 and 3 (refer to FIGS. 2A and 2B). The ink-jet head 41 is fixed to the printer at a position at which the nozzles 11 of the ink-jet head 41 face the upper surface of the recording paper P and the cap 43. Whereas, the ink-jet head 42 is fixed to an reversing-mechanism 45 which is rotatable around a shaft 45*a*. As shown in FIG. 6A, it is possible to arrange the ink-jet head 42 on a right side (the downstream side of the transporting path 15) in FIGS. 6A and 6B, at a position (the first position) at which the nozzles 11 face the upper surface of the recording paper P, and the cap 44. Furthermore, by rotating the reversing-mechanism 45, it is possible to move the ink-jet heads 42 to a position (a second position) which is almost the same position (with respect to the first position, at the upstream side of the transporting path 15) as the ink-jet head 41 in the paper transporting direction, and at which the nozzles 11 face the lower surface of the recording paper P. In this case, the ink-jet head 41 corresponds to a first liquid droplet jetting head according to the present invention, and the ink-jet head 42 corresponds to a second liquid droplet jetting head according to the present invention.

In this case, it is possible to carry out printing only on one surface (upper surface) of the recording paper P by jetting the ink on to the recording paper P from the nozzles 11 of the ink-jet heads 41 and 42 after moving the ink-jet head 42 to the first position as shown in FIG. 6A.

Even in this case, similarly as in the third modified embodiment, the recording paper P passes between the transporting roller 34 and the spur-roller 36 after the ink has landed on the upper surface thereof. At this time, the upper surface of the recording paper P makes a contact with the spur-roller 36. However, since the contact area of the recording paper P and the spur-roller 36 is small, the ink on the recording paper P hardly adheres to the spur-roller 36, and hardly adheres further to the other portion of the recording paper P. Accordingly, the degradation of the printing quality is prevented.

On the other hand, it is possible to carry out printing on both surfaces of the recording paper P by jetting the ink on to the recording paper P from the nozzles 11 of the ink-jet heads 41 and 42 after moving the ink-jet head 42 to the second position at which the nozzles 11 thereof face the lower surface of the recording paper P as shown in FIG. 6B.

In this case, the second position is positioned at a left side (the upstream side of the transporting path 15) of FIGS. 6A and 6B than the first position, in the paper transporting direction. The second position is away from the transporting roller 34 and the spur-roller 36. Therefore, as compared to a case in which the position in the paper feeding direction of the ink-jet head 42 at the time of carrying out printing on both surfaces of the recording paper P is same as a position at the time of carrying out printing only on the upper surface of the recording paper P, the time from the landing of the ink on the lower surface of the recording paper P up to passing between the transporting roller 34 and the spur-roller 36 becomes long. Consequently, the recording paper P passes between the transporting roller 34 and the spur-roller 36 upon drying of the ink thereon sufficiently, after the ink has landed on the lower surface thereof. Even when the lower surface of the recording paper P on which the ink has landed makes a contact with the transporting roller 34 with even surface, the ink landed on the lower surface of the recording paper P hardly adheres to the transporting roller 34. Accordingly, the degradation of the printing quality is prevented.

Furthermore, even in this case, at the time of carrying out printing on only one surface of the recording paper P and at the time of carrying out printing on both surfaces of the recording paper P, both the ink-jet heads 41 and 42 are used. Therefore, the frequency of use of one of the ink-jet heads 41 and 42 is not lower than the frequency of use of the other.

Fifth Modified Embodiment

In the above-mentioned description, there have been two pairs (roller pairs) of the transporting roller and the spur-roller. However, the number of pairs is not restricted to two.

Figures 7A, 7B:
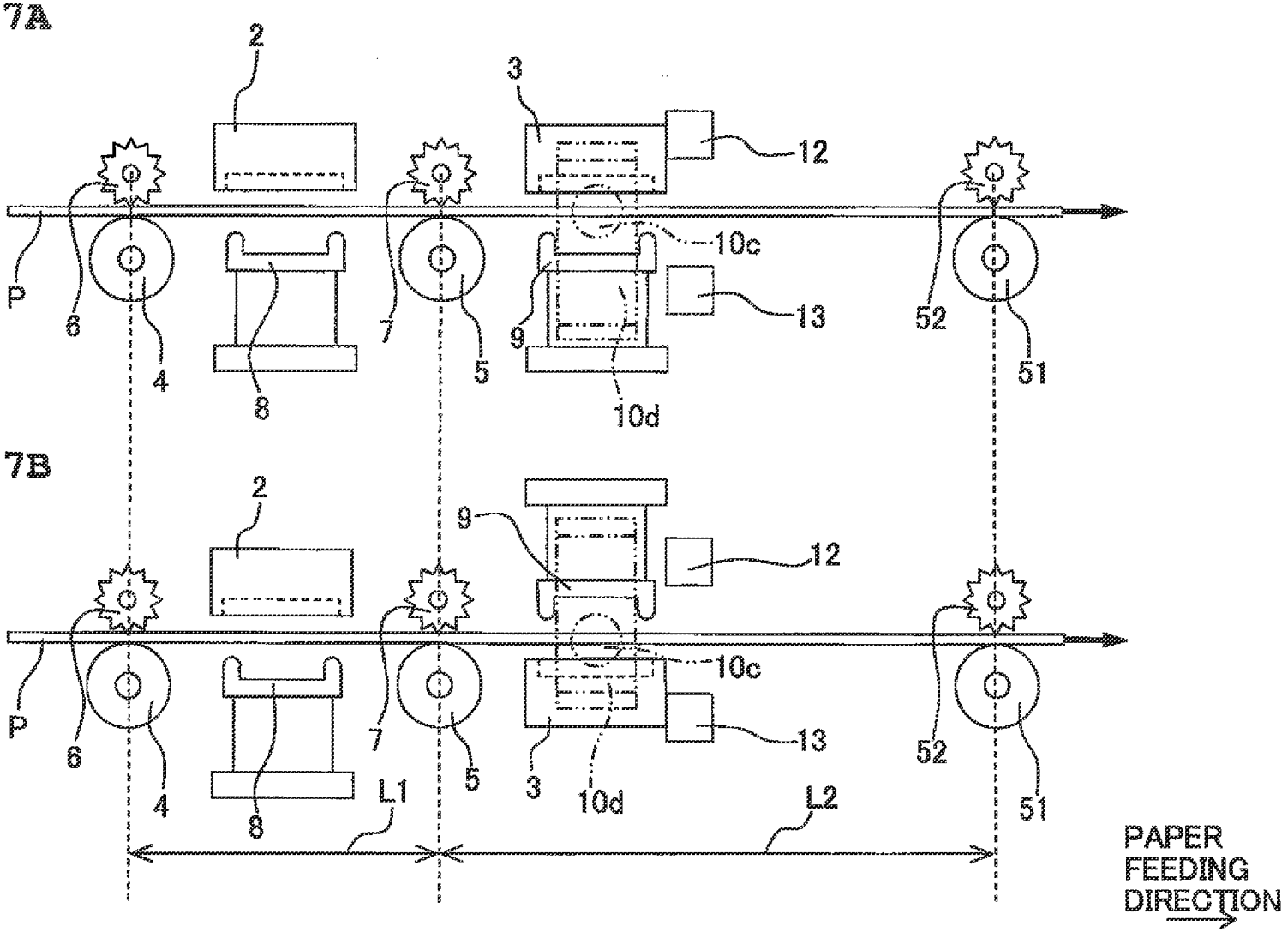
FIGS. 7A and 7B are diagrams corresponding to FIGS. 2A and 2B respectively, of a fifth modified embodiment.

As shown in FIGS. 7A and 7B, in addition to a first roller pair (the transporting roller 4 and the spur-roller 6) and a second roller pair (the transporting roller 5 and the spur-roller 7), a third roller pair including a transporting roller 51 facing the lower surface of the recording paper P at a right side (the downstream side of the transporting path 15) of the ink-jet head 3, and a spur-roller 52 facing the transporting roller 51, sandwiching the recording paper P between the transporting roller 51 and the spur-roller 52 is arranged. Moreover, a distance L2 between the second roller pair and the third roller pair is longer than a distance L1 between the first roller pair and the second roller pair. In this case, a pair of the transporting roller 51 and the spur-roller 52 corresponds to the third roller pair according to the present invention, and the third roller pair is adjacent to the downstream side of the transporting path of the ink-jet head 3 (the second position), of the second roller pair.

In this case, since there are three roller pairs which include the transporting roller and the spur-roller, the number of locations at which the recording paper P is sandwiched between the roller pairs become more as compared to a case in which there are only two roller pairs. Therefore, and it is possible to transport the recording paper P stably.

Moreover, the distance L2 is longer than the distance L1. Therefore, it is possible to arrange the ink-jet heads 2 and 3 such that a distance between the ink-jet head 2 and the transporting roller 51 becomes longer than a distance of the ink-jet head 2 and the transporting roller 5, in the paper transporting direction as shown in FIGS. 7A and 7B. Therefore, the time after the ink has landed on the lower surface of the recording paper P till passing of the recording paper P between the transporting roller 51 and the spur-roller 52 becomes long similarly as in the embodiment. Consequently, the recording paper P passes between the transporting roller 51 and the spur-roller 52 after the ink thereon has dried sufficiently. Even when the lower surface of the recording paper P makes a contact with the transporting roller 51 with even surface, the ink on the lower surface of the recording paper P hardly adheres to the transporting roller 51. Consequently, the ink hardly adheres to the other portion on the lower surface of the recording paper P from the transporting roller 51. Accordingly, the printing quality is prevented from being degraded.

Even in the fifth modified embodiment having a structure in which the transporting roller 51 and the spur-roller 52 are added to the structure in the embodiment described above, it is possible to achieve an effect similar to an effect in the embodiment.

Sixth Modified Embodiment

Figure 8A:
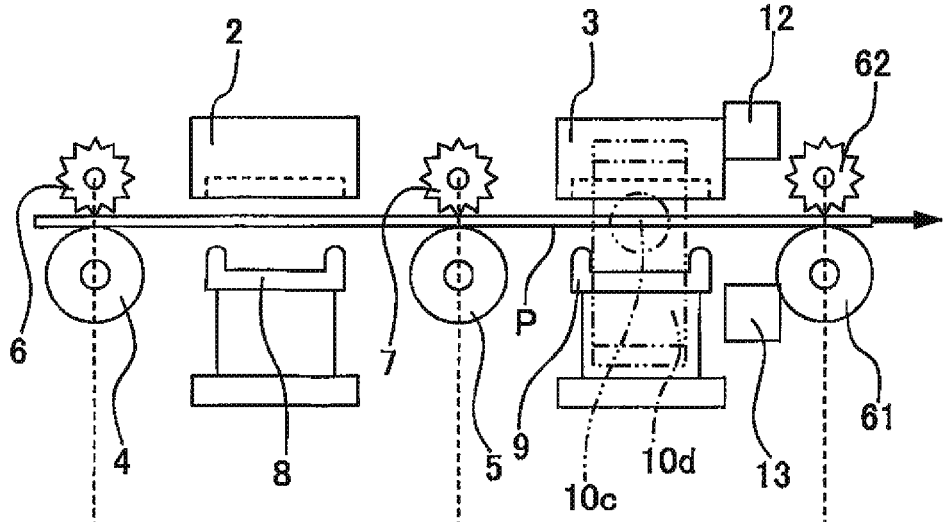
FIGS. 8A and 8B are diagrams corresponding to FIGS. 2A and 2B respectively, of a sixth modified embodiment.
Figure 8B:
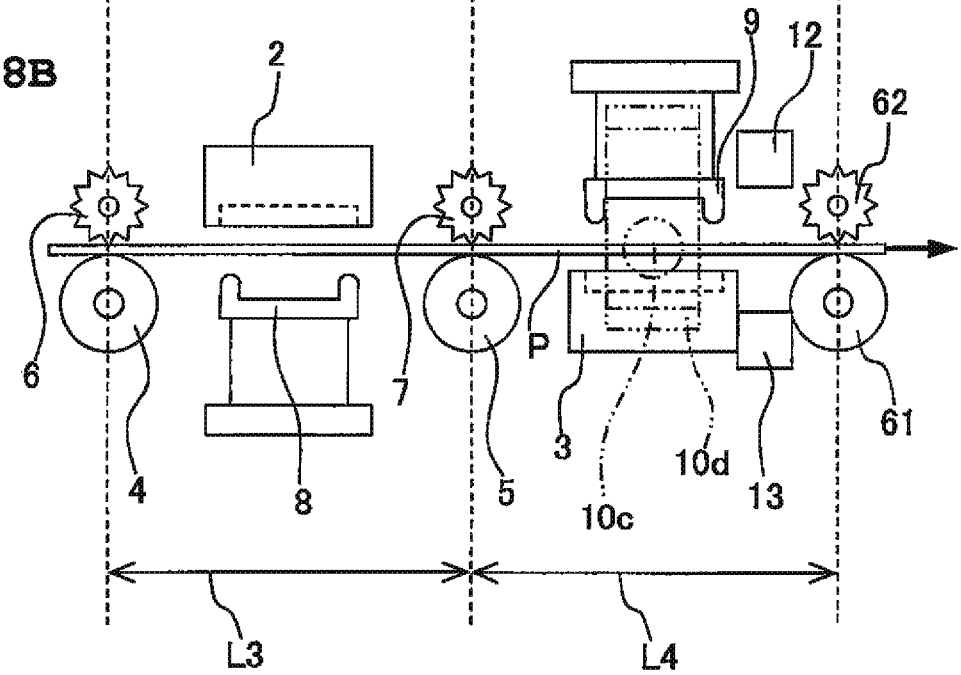

In the fifth modified embodiment, the length L2 is longer than the length L1. However, the present invention is not restricted to such arrangement. In a sixth modified embodiment, similarly as in the fifth modified embodiment, a pair of a transporting roller 61 and a spur-roller 62 (a third roller pair)

is arranged at a downstream side (a right side in FIG. 8) in the paper transporting direction of the ink-jet head as shown in FIGS. 8A and 8B. A length L4 between the transporting roller 5 and the spur-roller 7 (the second roller pair), and the transporting roller 61 and the spur-roller 62 (the third roller pair) in the paper transporting direction is almost same as the distance L3 between the transporting roller 4 and the spur-roller 6 (the first roller pair), and the transporting roller 5 and the spur-roller 7 (the second roller pair).

Here, unlike in the fifth modified embodiment, the ink-jet head 3 is fixed to the printer such that the nozzles 11 thereof face the upper surface of the recording paper P, and also, the ink-jet head 2 is movable to a position at which the nozzles 11 thereof face the upper surface and the lower surface of the recording paper P, without changing a position in the paper transporting direction. In a case of carrying out printing on the lower surface of the recording paper by jetting the ink on to the lower surface of the recording paper P from the nozzles 11 of the ink-jet head 2, the recording paper P having the ink landed on the lower surface thereof passes between the transporting roller 5 and the spur-roller 7, and between the transporting roller 61 and the spur-roller 62. Therefore, there is a possibility that the ink landed on the lower surface of the recording paper P adheres to the two transporting rollers 5 and 61, and further to the other portion of the recording paper, thereby degrading the printing quality.

Whereas, in the sixth modified embodiment, since the distance between the ink-jet head 3 which jets the ink onto the lower surface of the recording paper P and the transporting roller 61 is short as compared to the case in the fifth modified embodiment, the recording paper P passes between the transporting roller 61 and the spur-roller 62 before the ink landed on the lower surface of the recording paper P has dried sufficiently, and although there is a possibility that the ink adheres to the transporting roller 61, since the recording paper P passes between the transporting roller 61 and the spur-roller 62 after the ink is jetted on to the lower surface of the recording paper P, and does not pass between the transporting roller 5 and the spur-roller 7, as the ink is not adhered to the transporting roller 7, the degrading of the image quality is suppressed.

It is needless to mention that, even in the sixth modified embodiment, it is possible to achieve an effect similar as in the embodiment described above.

Moreover, in the fifth and sixth modified embodiments, even when the ink-jet head 3 is at the first position at which the nozzles 11 of the ink-jet head 3 face the upper surface of the recording paper P, and at the second position at which the nozzles 11 of the ink-jet head 3 face the lower surface of the recording paper P, the third roller pair has been provided to the printer having the same position in the paper transporting direction. However, the present invention is not restricted to such arrangement.

Seventh Modified Embodiment

Figure 9A:
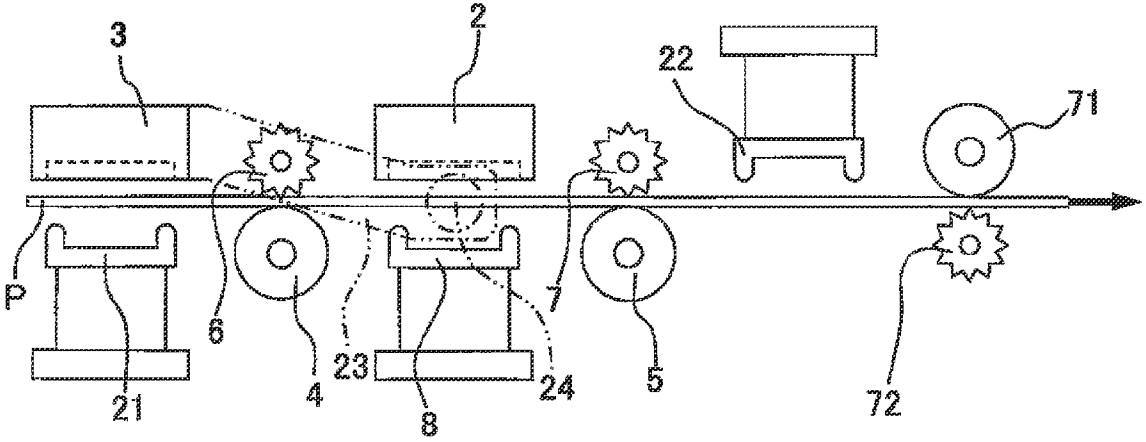
FIGS. 9A and 9B are diagrams corresponding to FIGS. 2A and 2B respectively, of a seventh modified embodiment.
Figure 9B:
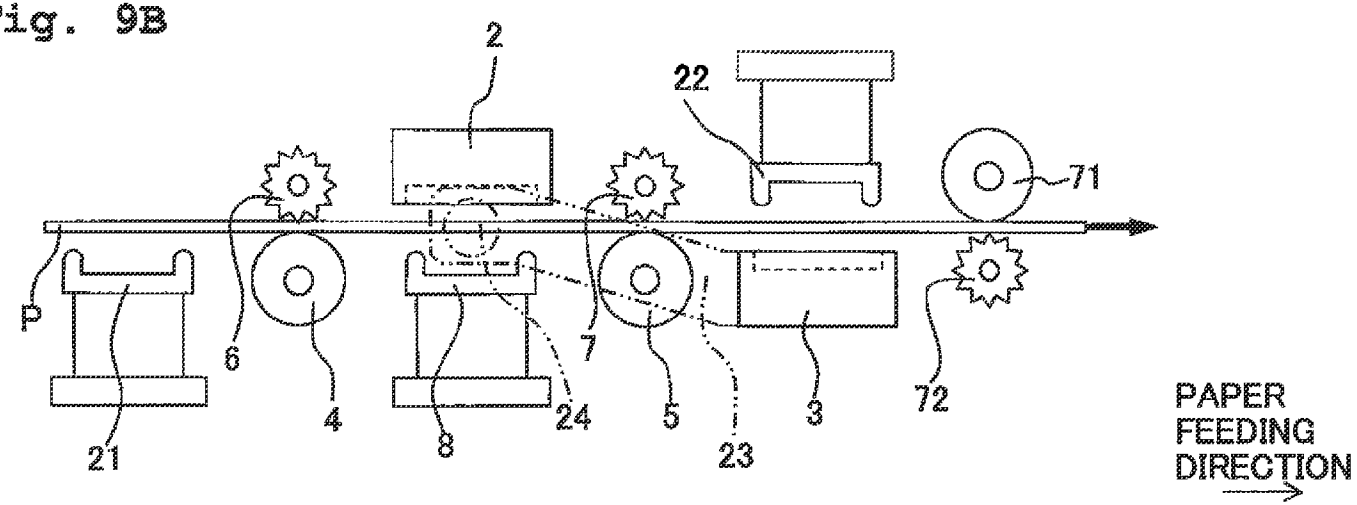

As shown in FIGS. 9A and 9B, in addition to the structure similar to that in the second modified embodiment, with respect to the paper transporting direction, the cap 22 and a pair of a transporting roller 71 and a spur-roller 72 (a third roller pair) are arranged at a right side of the ink-jet head 3 which is at the second position. In this case, among these three roller pairs, the third roller pair is adjacent to the downstream side in the transporting path of the second position of the second roller pair. In this manner, the third roller pair may be provided to the printer in which the ink-jet head is movable between two different positions (the first position and the second position) in the paper transporting direction. Moreover, in the seventh modified embodiment, the spur-roller 72 faces the lower surface of the recording paper P, and the transporting roller 71 faces the upper surface of the recording paper P. Therefore, as shown in FIG. 9B, even when the ink-jet head 3 has carried out printing on the lower surface of the recording paper P, the lower surface of the recording paper P on which the ink has landed makes a contact with the spur-roller 72. Therefore, similarly as in the embodiment described above, there is no possibility of the recording paper getting stained by the droplets of ink.

Moreover, the number of pairs of the transporting roller and the spur-roller is not restricted to two or three. Four or more pairs of the transporting roller and the spur-roller may be provided. In any of the embodiment and the modified embodiments, for improving a liquid repellent property of the surface of the transporting roller and/or the spur-roller, the surface thereof may be coated by a material having a superior liquid repellent property, such as a fluororesin. Or, the transporting roller and/or the spur-roller may be formed of a material having a superior liquid repellent property. In any of the cases, it is possible to prevent the ink landed on the recording paper from adhering to the transporting roller and/or the spur-roller, and it is possible to prevent the ink from adhering further to the other portion of the recording paper, thereby degrading the printing quality substantially. Particularly, by providing a material having a superior liquid repellent property to the surface of the transporting roller, it is possible to suppress the ink from adhering to the other portion of the recording paper P.

Figure 10:
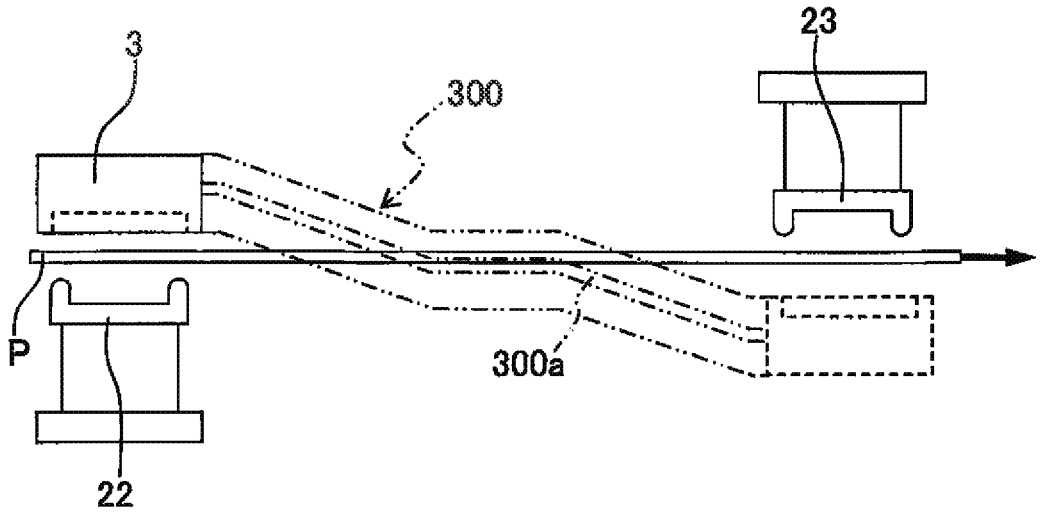
FIG. 10 is a diagram showing the sliding mechanism as an example of the reversing-mechanism.

The above-mentioned description has been made by citing an example of an reversing-mechanism which is rotatable (pivotable) around a predetermined shaft as a rotation-axis. However, the present invention is not restricted to such arrangement. For example, as shown in FIG. 10, the reversing-mechanism may have a sliding mechanism 300 which slidably supports the ink-jet head. Even in this case, it is possible to move the ink-jet head between the first position and the second position along a groove 300*a* formed in the sliding mechanism. Moreover, at the second position, the ink-jet head is capable of rotating such that the nozzle surface face the recording paper.

In the present invention, the printer may have a controller (not shown in the diagrams) which controls the reversing-mechanism based on a command (instruction) inputted to the controller. The command may be inputted from the external PC connected to the ink-jet printer or may be inputted from an input device (such as a touch-panel device) provided in the printer. When a single-face printing is selected, the controller controls the reversing-mechanism to move the ink-jet head 3 to the first position. When a double-face printing is selected, the controller controls the reversing-mechanism to move the ink-jet head 3 to the second position.

In the above-mentioned description, the black ink has been jetted from the two line heads. However, the present invention is not restricted to such arrangement. For example, the present invention may be applied to line heads which jet an ink other than the black ink (such as a color ink). Specifically, the ink-jet printer according to the present invention may have two sets of line heads each set including a head for the black ink and heads for the color inks (nozzles which jet inks of plurality of colors may be formed in one color line head). In this case, each of the line heads included in one of the two set can be movable by using the reversing-mechanism. When the ink-jet printer has a plurality of the movable line heads for black and color inks, the movable line heads may be reversed separately, or may be reversed simultaneously. Alternatively, the ink-jet printer according to the present invention may have two black line heads as described above embodiments, and a color head/color heads arranged to face the one surface of the paper. In this case, at the single-face printing, a color-printing, a high-speed/high-quality printing for the black ink is available. Moreover, the double-face printing for the black ink is also available.

In the present invention, an example in which the present invention is applied to a printer which carries out printing on a recording paper by jetting the ink from the nozzles has been described. The present invention is also applicable to liquid droplet jetting apparatuses which jet droplets of a liquid other than ink from nozzles on an object to be jetted.

According to the present invention, when the second liquid droplet jetting head is moved to the first position, it is possible to jet the liquid droplets only on one surface of the jetting object by using the first liquid droplet jetting head and the second liquid droplet jetting head. Further, when the second liquid droplet jetting head is moved to the second position, it is possible to jet the liquid droplets on both surfaces of the jetting object by using the first liquid droplet jetting head and the second liquid droplet jetting head. Consequently, in any of a case of jetting the liquid droplets only on one surface of the jetting object, and a case of jetting the liquid droplets on both surfaces of the jetting object, both the first liquid droplet jetting head and the second liquid droplet jetting head are used, and the frequency of use of one of the first and second liquid droplet jetting heads is not lowered than the frequency of use of the other. Therefore, one of the first and second liquid droplet jetting heads is prevented from being degraded earlier than the other. Moreover, since it is possible to carry out a maintenance process for the two liquid droplet jetting heads (for the first liquid droplet jetting head and the second liquid droplet jetting head) with about the same frequency, it is not necessary to carry out maintenance with an extremely high frequency for only one of the two liquid droplet jetting heads. In other words, in the conventional ink-jet printer provided with two ink-jet heads for the double-face printing, since the frequency of use for one of the ink-jet heads used for single-face printing becomes high, there has been a possibility of degrading earlier than the other ink-jet head. Moreover, it has been necessary to carry out a purge for both the ink-jet heads together with the ink-jet head which is degraded earlier due to the high frequency of use, and there has been a possibility of consuming the ink excessively. Whereas, in the liquid droplet jetting apparatus according to the present invention, it is possible to prevent one of the ink-jet heads from degrading earlier than the other, and there is no excessive consumption of ink.

What is claimed is:

1. A liquid droplet jetting apparatus which jets liquid droplets onto a plane-shaped object, comprising:

a transporting mechanism configured to transport the object;

a first liquid droplet jetting head in which a plurality of first nozzles is aligned in a nozzle-row direction at a pitch to form a first nozzle row, and which is arranged to face one surface of the object transported by the transporting mechanism;

a second liquid droplet jetting head in which a plurality of second nozzles is aligned in the nozzle-row direction at the pitch to form a second nozzle row, and which is configured to be movable between a first position facing the one surface of the object transported by the transporting mechanism and a second position facing the other surface of the object transported by the transporting mechanism;

a head moving mechanism configured to move the second liquid droplet jetting head between the first position and the second position; and a controller configured to control the transporting mechanism and the first and second liquid droplet jetting heads so that a transporting speed of the sheet-shaped object in a case that the second liquid droplet jetting head is arranged at the first position, is higher than a transporting speed of the sheet-shaped object in a case that the second liquid droplet jetting head is arranged at the second position;

wherein under a condition that the second liquid droplet jetting head is arranged at the first position, the first nozzle row and the second nozzle row are arranged such that each of the first nozzles is overlapped with one of the second nozzles with respect to the nozzle-row direction; and wherein the first and second liquid droplet jetting heads are configured to jet a same color of liquid onto the plane-shaped object.

2. The liquid droplet jetting apparatus according to claim 1;

wherein the controller is configured to control the transporting mechanism and the first and second liquid droplet jetting heads so that a resolution of an image formed on the plane-shaped object in a case that the second liquid droplet jetting heat is arranged at the first position is same as a resolution of an image formed on the plane-shaped object in a case that the second liquid droplet jetting head is arranged at the second position.

* * * * *